United States Patent [19]

Zaffarano

[11] 4,172,565

[45] Oct. 30, 1979

[54] APPARATUS FOR WINDING STRIP MATERIAL

[75] Inventor: Frank P. Zaffarano, Rocky River, Ohio

[73] Assignee: Gould Inc., Rolling Meadows, Ill.

[21] Appl. No.: 869,196

[22] Filed: Jan. 13, 1978

[51] Int. Cl.[2] ..... B65H 17/02; B65H 25/04; B65H 23/26

[52] U.S. Cl. ..... 242/67.1 R; 242/68.4; 242/75.2; 242/75.51; 242/76

[58] Field of Search ..... 242/75.51, 75.5, 75.52, 242/75.2, 68.4, 72 R, 72.1, 77.1, 56 R, 76, 67.1–67.5

[56] References Cited

U.S. PATENT DOCUMENTS

| | | | |
|---|---|---|---|
| 385,026 | 6/1888 | Waldron | 242/72.1 |
| 1,261,225 | 4/1918 | Galloway | 242/75.2 |
| 2,547,201 | 4/1951 | Febely | 242/75.52 X |
| 2,729,402 | 1/1956 | Kramer . | |
| 2,741,176 | 4/1956 | Hollis . | |
| 2,851,226 | 9/1958 | Wellington . | |
| 3,033,481 | 5/1962 | Wolk . | |
| 3,180,549 | 4/1965 | Buhrendorf et al. . | |
| 3,191,884 | 6/1965 | West et al. . | |
| 3,601,328 | 8/1971 | McClung | 242/68.4 |
| 3,610,545 | 10/1971 | Reifenhauser et al. | 242/56 R |
| 3,722,822 | 3/1973 | Wallace | 242/75.5 |
| 3,768,752 | 10/1973 | Bettini et al. . | |
| 3,844,463 | 10/1974 | Copp | 242/75.51 |
| 3,890,547 | 6/1975 | Keck | 242/75.51 X |

*Primary Examiner*—Harvey O. Hornsby
*Assistant Examiner*—John M. Jillions
*Attorney, Agent, or Firm*—Charles E. Snee, III

[57] ABSTRACT

An apparatus is disclosed for winding a strip of thin material such as paper. The apparatus is particularly suited for use with variable speed printer-plotter machines which discharge paper over a wide range of speeds. Such machines require that the tension applied to the paper by the paper take-up mechanism be minimized or maintained within pre-selected limits so that printing-plotting quality is maintained. To this end, the apparatus permits the paper to fall in a free loop between two points of support and includes a sensor which monitors the condition of the loop and actuates a take-up motor when the loop achieves a predetermined magnitude.

9 Claims, 7 Drawing Figures

APPARATUS FOR WINDING STRIP MATERIAL

BACKGROUND OF THE INVENTION

In the recording, printing and plotting technologies, many applications are known in which the strip of paper or other medium leaving the recorder or printer-plotter travels at speeds ranging from as high as several inches per second to as low as only a few inches per hour, depending upon the speed required to provide adequate resolution of the data being presented. Particularly in the field of electrostatic printer-plotters, the tension applied to the paper as it moves through the machine is an important variable since improper tension can adversely affect the performance of the printer-plotter. In recognition of this problem, it has been known in the past to simply allow the paper leaving the printer-plotter to spew or fall into a catch basket or similar container from which it is subsequently removed, rather than to wind the paper by some means which might apply improper tension. Those skilled in the art will recognize that the problem of handling unwound or unfolded paper is considerable, especially when the paper is very wide, very long or both. In the prior art, various attempts have been made to control paper tension, such as the use of slip clutches and torque motors. While some degree of success has been achieved with these approaches, power consumption, stalled motors and clutch failure have been continuing problems. Another problem concerns the need in prior art systems to very precisely align the take-up mechanism with the recorder or other feed station, since misalignment causes uneven paper winding due to wandering of the paper on the take up roll. An efficient apparatus has been needed for winding the paper as it leaves the printer-plotter without at the time applying an improper tension to the paper which might affect printer-plotter performance. Moreover, means for avoiding the need for precise alignment have been in demand.

OBJECTS OF THE INVENTION

An object of the invention is to provide an apparatus for winding a strip of thin material such as paper while maintaining the tension applied to the paper within preselected limits.

Another object of the invention is to provide such an apparatus which is rather easily adapted for use in a variety of applications and is simple and economical to manufacture.

Still another object of the invention is to provide such an apparatus which will not require precise alignment with the source of the strip of thin material in order to ensure proper operation.

Still another object of the invention is to provide such an apparatus in which winding of the strip of thin material will proceed as necessary, independent of the speed at which the material leaves the associated printer-plotter or other feed station.

A still further object of the invention is to provide such an apparatus in which the roll of wound strip material may be easily removed from the apparatus and the mandrel supporting the roll easily removed from the roll.

Yet another object of the invention is to provide such an apparatus which may be simply set up and prepared for operation by an unskilled attendant.

The above objects of the invention are given only by way of example. Thus, other objects and advantages inherently achieved by the invention may occur to those skilled in the art. Nonetheless, the scope of the invention is to be limited only by the appended claims.

SUMMARY OF THE INVENTION

The above objects and other desirable advantages are achieved by the disclosed invention which comprises an apparatus for winding a continuous strip of material such as paper which is intermittently or continuously fed from an adjacent feed station. The apparatus includes a mandrel or core support tube about which the strip is wound and means such as a selectively actuable electric motor for rotating the mandrel to wind the strip thereon. The strip is supported at two spaced locations upstream of the location at which it is wound onto the mandrel so that a free loop profile is assumed by the strip. Paper guide collars at the location closest to the mandrel guide the paper onto the mandrel without requiring precise alignment of the apparatus to the adjacent feed station. A sensor is positioned to coact with the strip between the two spaced locations to actuate the motor in response to the magnitude of the portion of the strip between the spaced locations. In a preferred embodiment of the invention, the free loop of strip material actuates a microswitch positioned near the loop. In addition, the apparatus includes supports for the mandrel on which the strip of material is wound which both facilitate removal of the wound material from the apparatus and limit axial layer to layer slippage of the paper as the roll diameter grows.

DETAILED DESCRIPTION OF THE PREFERRED EMBODIMENT

Figure 1:
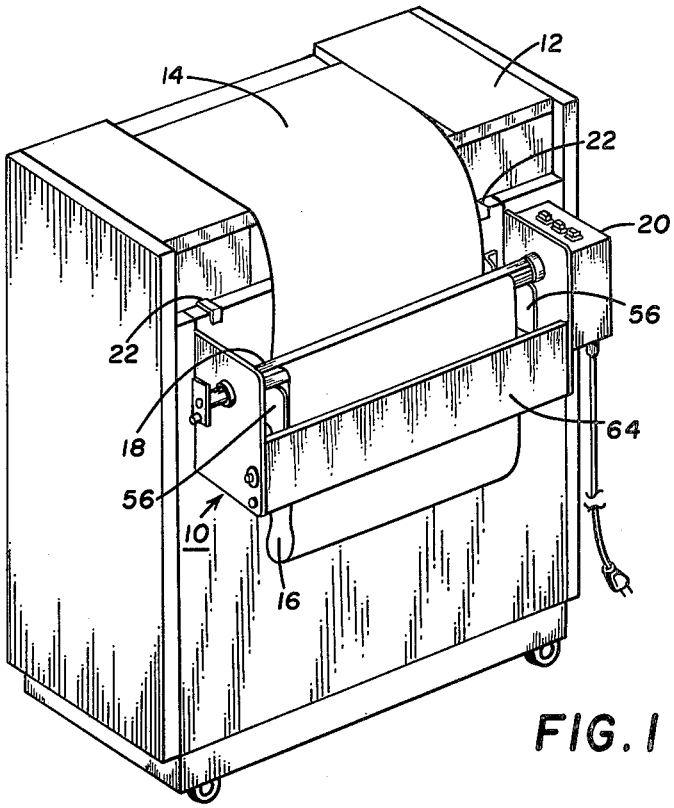
FIG. 1 shows a perspective view of an apparatus for winding a strip of material according to the invention, the apparatus being illustrated as it would be attached to a printer-plotter of known design.

There follows a detailed description of the preferred embodiment of the invention, reference being had to the drawings in which like reference numerals identify like elements of structure in each of the several figures.

FIG. 1 illustrates a perspective view of a conventional printer-plotter which has been modified by the addition of a winding apparatus or take-up mechanism according to the present invention. The chart take-up apparatus 10 according to the invention is illustrated attached to a conventional printer-plotter 12; however, those skilled in the art will appreciate that the invention may also be used with other types of feed stations which deliver a strip of thin material such as paper at intermittent or continuous speed. A strip 14 of recorder paper is fed from the upper portion of printer-plotter 12. As strip 14 leaves printer-plotter 12, it falls downward to form a free loop 16; and then is brought upward, through a friction tube assembly (See FIGS. 3, 4 and 4*a*) and inserted into a winding mandrel or paper core tube 18. Mandrel 18 is rotated under the influence of suitable electric motor which is located in a control console 20, as will be discussed in further detail with regard to FIGS. 3 and 5. Finally, a pair of laterally spaced mounting clamps 22 are used to affix the apparatus to printer-plotter 12.

Figure 2:
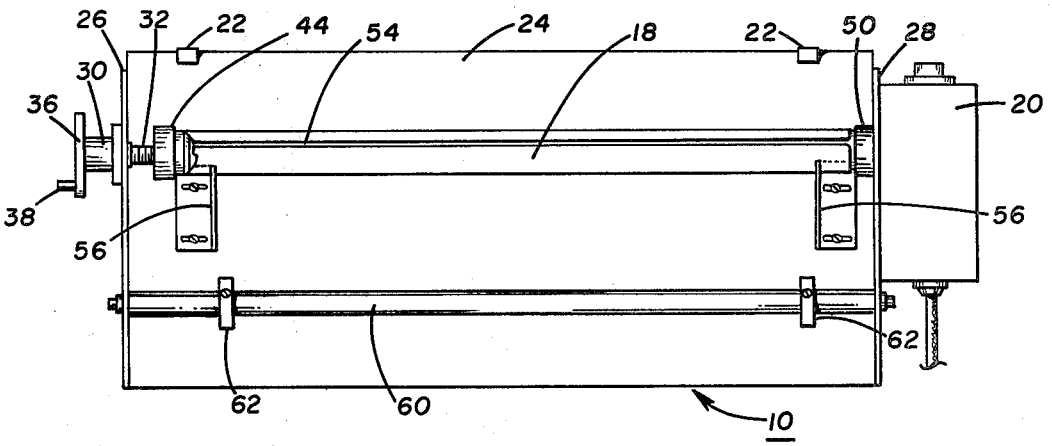
FIG. 2 shows a front view, partially disassembled, of the apparatus according to the invention.
Figures 3, 3A:
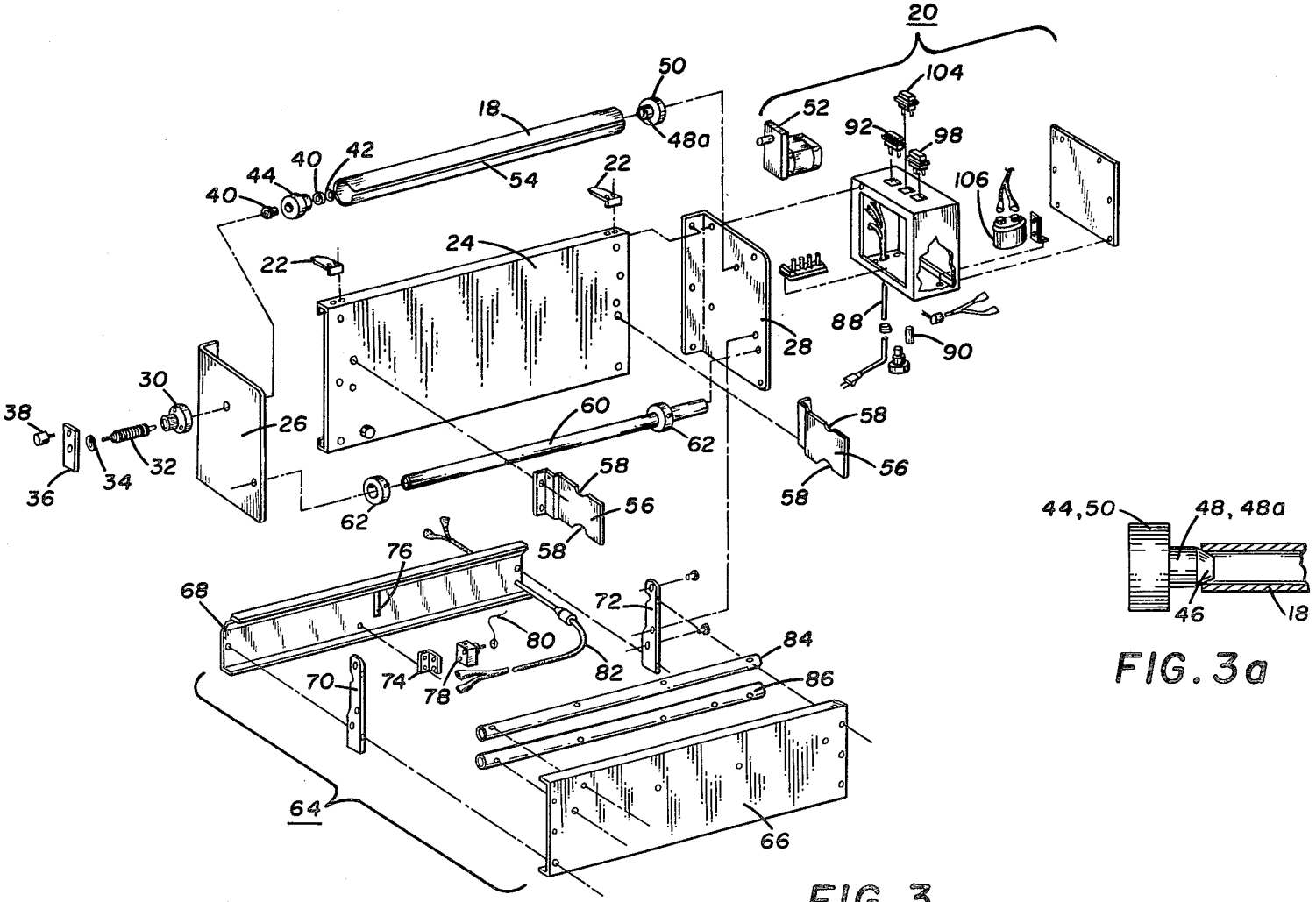
FIG. 3 shows an exploded view of the apparatus according to the invention illustrating the configuration and relative orientation of its major component parts.
FIG. 3*a* shows a fragmentary view of the mandrel and one of its mandrel support hubs according to the invention.

Looking now to FIGS. 2 and 3, the structural details of the take-up apparatus according to the invention may be understood. Apparatus 10 comprises a support frame which is made up from a base plate 24 to which are attached a mandrel support plate 26 and a motor support plate 28, all suitably joined together to form a U-shaped frame. A threaded hub 30 is attached to a mandrel support plate 26 for rotatably receiving a retracting screw 32. The outer end of retracting screw 32 receives a washer 34, crank arm 36 and actuator knob 38 to provide a manual means for securing mandrel 18 within the apparatus. The inner end of retracting screw 32 supports a pair of bearings 40 which are secured by a retainer ring 42 and which rotatably mount a core hub 44. As shown in FIG. 3*a*, core hub 44 comprises a conical portion 46 which is sized to extend into the interior of mandrel 18 so that as the conical portion is forced into mandrel 18, the mandrel will expand and gradually move onto a cylindrical portion 48 of core hub 44. At the opposite end of the apparatus on motor support plate 28, a driven core hub 50, similar to hub 44, is provided which is attached to the shaft of a motor 52 mounted on the opposite side of support plate 28.

To facilitate its expansion over hubs 44 and 50, mandrel 18 comprises a thin walled cylinder of resilient material having a longitudinal slit 54 through its wall. Thus, when hubs 44 and 50 are inserted into mandrel 18 by operating retracting screw 32, mandrel 18 will gradually ride over conical portion 46, of hubs 44, 50 and slide onto their cylindrical portions, 48,48*a*. Preferably, cylindrical portion 48*a* of hub 50 is somewhat longer than cylindrical portion 48 of hub 44 so that when retracting screw 32 is actuated to withdraw hub 44 from mandrel 18, mandrel 18 will continue to be supported by hub 50 after hub 44 has been completely withdrawn. Thus, mandrel 18 may be easily pivoted upward about hub 50, thereby facilitating removal of the mandrel and the strip of material wound thereon from the apparatus. After a roll of strip material has been removed from the apparatus, mandrel 18 will collapse to its unexpanded size so that it may be easily removed from the roll of material.

Mounted just below mandrel 18 are right and left paper guides 56 which extend outwardly beneath mandrel 18 to confine lateral movement of the paper as it is wound on the mandrel. Otherwise, the paper would tend to move or wander axially on mandrel 18 and could eventually interfere with further winding. Guides 56 comprise cutaway cradle surfaces 58 on their upper edges which also serve to support mandrel 18 when it is not being supported by either hub 44 or hub 50. Surfaces 58 are positioned so that hubs 44, 50 are essentially aligned with mandrel 18 when the mandrel is resting on the support surfaces. Thus, hubs 44, 50 may be easily engaged with the mandrel by simply rotating crank 36. As illustrated in FIG. 2, guides 56 comprise slotted mounting holes to facilitate lateral adjustment for strip materials of varying widths.

Also mounted between support plates 26 and 28 is a non-rotating spacer bar 60 which includes a pair of laterally movable shaft collars 62 used to adjust the position of the strip of material as it passes friction tubes 84, 86 and approaches mandrel 18. (See also FIGS. 4 and 4*a*) A combined access cover and paper sensor support 64 is pivotally mounted to support plates 26 and 28 to permit movement between the two positions illustrated in FIGS. 4 and 4*a*. Cover 64 comprises a guide tube support panel 66 and a paper sensor support panel 68 joined at their ends by a pair of end plates 70,72. Between panels 66 and 68, a sensor mounting bracket 74 is provided adjacent to a slot 76 through the back surface of sensor support panel 68. Mounted on bracket 74 is a sensor switch 78 which includes a resiliently biased actuator arm 80, positioned to extend through slot 76 to a location adjacent loop 16 as it moves through the apparatus. Finally, a suitable electrical connector 82 joins sensor switch 78 to the circuitry housed in control console 20.

Figure 4:
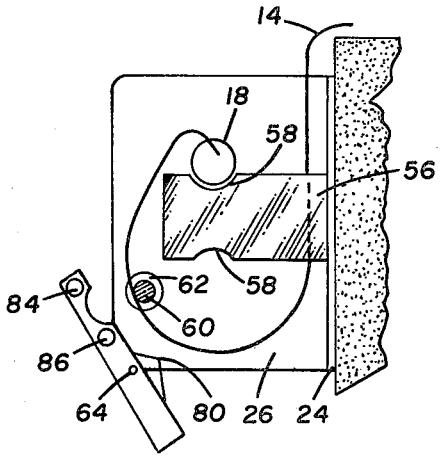
FIGS. 4 and 4*a* respectively show side, partially sectional views of the invention illustrating the method of threading the strip of material through the apparatus and the coaction of the loop of material with the loop sensor.
Figure 4A:
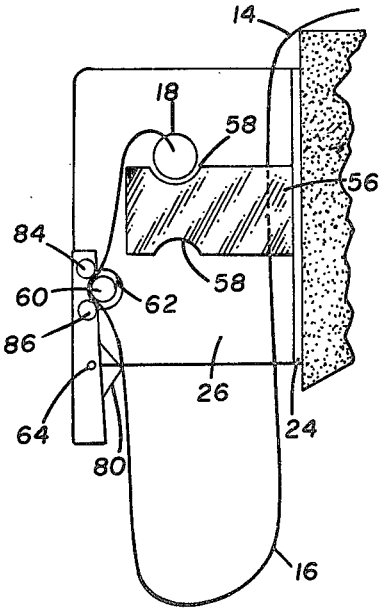

Mounted on guide tube support panel 66 just above paper sensor support panel 68 are a pair of non-rotating friction tubes 84,86 which are spaced from each other and positioned so as to lie closely adjacent to spacer bar 60 when cover 64 has been closed, as illustrated in FIG. 4*a*. Friction tubes 84 and 86 and spacer bar 60 cooperate as illusrated in FIG. 4*a* to support one end of loop 16. Friction tubes 84, 86 constrain paper 14 to bend around bar 60 and assume an arcuate configuration at the location where the paper passes between shaft collars 62. This configuration of the otherwise limp paper imparts to it a desirable lateral stiffness so that shaft collars 62 can act on the paper edges to guide the paper laterally into proper position for winding on mandrel 18, without damaging the paper. The other end of the loop is supported at the point at which strip 14 leaves the adjacent printer-plotter or other feed station. Between these two spaced locations, loop 16 will grow as feed continues until the free loop achieves a sufficient magnitude to actuate sensor switch 78 and thereby actuate the control circuitry located in control console 20. Thus, the strip of material automatically adjusts its lateral position in cooperation with elements 60, 62, 84 and 86, while proper tensioning takes place simultaneously. Because of this, precise alignment with the feed station is not required. Preferably, the spacer bar 60 and friction tubes 84, 86 should not rotate during operation, since this will cause the entry angle of the paper to be maintained, thereby requiring rather precise alignment of the take-up mechanism and the feed station for best operation.

Figure 5:
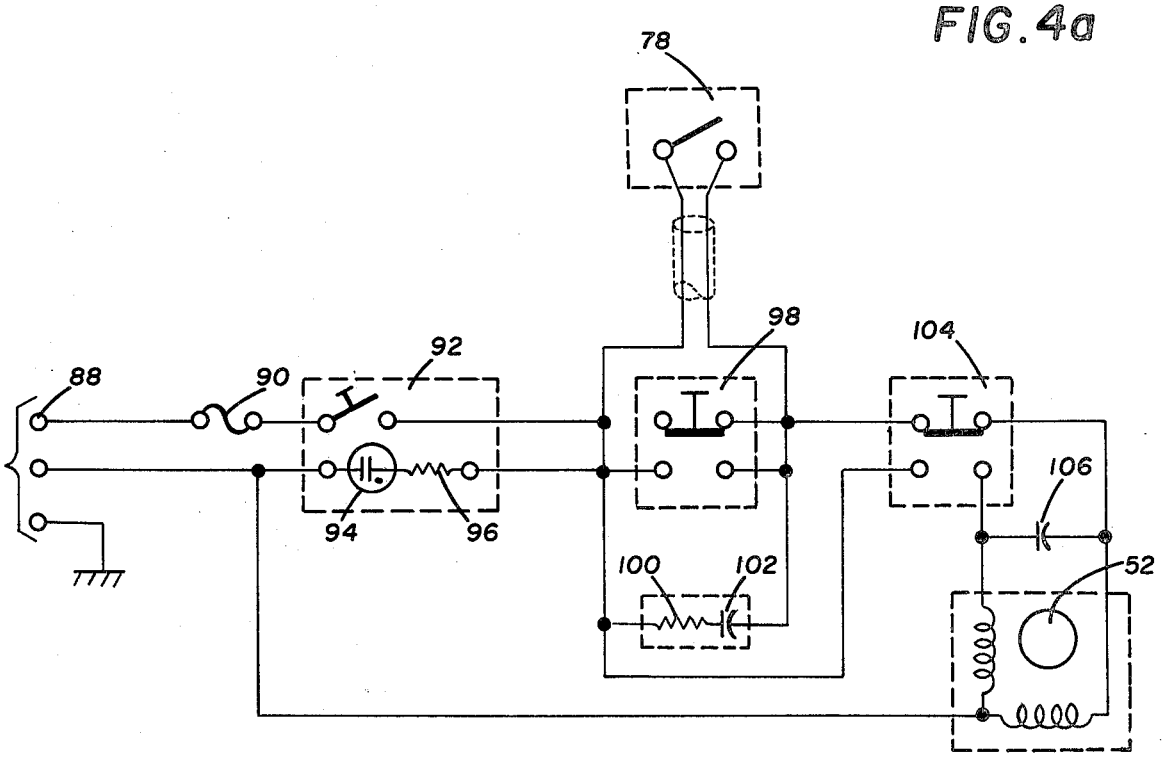
FIG. 5 shows a circuit diagram of the control circuitry for the apparatus.

Referring jointly to FIGS. 3 and 5, control console 20 is seen to comprise a suitable power connector 88, an overload fuse 90 connected in series and Main Power Switch 92 connected in series with fuse 90. A Power-On lamp 94 and resistor 96 are connected in the return line from Main Power Switch 92 to indicate that main power to the apparatus has been turned on. Sensor switch 78 is connected in parallel with a Jog Switch 98 having a noise suppressor made up of a resistor 100 and capacitor 102 connected in parallel therewith. A reverse Switch 104 may be used to reverse the direction of operation of motor 50 which is controlled with the aid of a phasing capacitor 106.

In operation, the strip of thin material such as paper is withdrawn from the adjacent feed station as illustrated in FIGS. 4 and 4a; fed around spacer bar 60; and inserted through longitudinal slot 54 into the interior of mandrel 18. Mandrel 18 is then rotated sufficiently to ensure that the material will not slip easily therefrom. Cover 64 is closed to engage friction tubes 84,86. As the adjacent feed station operates, loop 16 will eventually grow to a size sufficient to close sensor switch 78, thereby starting motor 52 which will pull strip 14 past friction tubes 84,86 and onto mandrel 18 until switch 78 opens again. Shaft collars 62 guide strip 14 as it moves. Those skilled in the art will appreciate that by this means the tension applied to strip 14 as it moves through the adjacent feed station is always maintained within preselected limits. If it is desired to remove the strip of material wound on mandrel 18, power switch 92 is opened and crank 36 is rotated as necessary to withdraw core hub 44 from mandrel 18. At this time, mandrel 18 and the material wound thereon may be easily grasped and pivoted about hub 50 upwardly to facilitate removal from the machine. Mandrel 18 may then be easily removed from the wound material and replaced in the apparatus to ready it for continued use.

Having thus described my invention in sufficient detail to enable those skilled in the art to make and use it, I claim:

1. Apparatus for winding a continuous strip of material such as paper as said strip is intermittently or continuously fed from an adjacent station, said apparatus comprising:

a mandrel made up of a thin-walled resilient cylinder;

means for rotating said mandrel to wind said strip, said rotating means comprising a pair of conically shaped hubs, one disposed at each end of said mandrel in position to be inserted therein, whereby said resilient cylinder expands as said conically shaped hubs are inserted therein, said hubs each comprising a cylindrical portion over which said resilient mandrel slides after expanding over said conical portions, one of said cylindrical portions being longer than the other, whereby said mandrel remains supported on said one portion when said other portion has been withdrawn from said mandrel;

means for supporting said strip at two spaced locations upstream of said mandrel, whereby a free loop profile is assumed by said strip;

means for adjusting the lateral position of said strip as it approaches said mandrel; and means positioned to coact with said strip between said two spaced locations for actuating said means for rotating in response to the magnitude of the portion of said strip between said two spaced locations.

2. Apparatus according to claim 1, further comprising means for supporting said mandrel when said rotating means is disengaged from said mandrel.

3. Apparatus according to claim 1, wherein said adjusting means comprises at least one elongated bar over which said strip passes as it approaches said mandrel; means for positioning said strip along the length of said bar; and means for bending said strip at least partially around said bar.

4. Apparatus according to claim 3, wherein said positioning means comprise a pair of laterally adjustable collars on said bar, said collars being positioned to coact with the edge of said strip.

5. Apparatus according to claim 4, wherein said bending means comprises a pair of friction elements spaced adjacent to said bar, said strip being threaded between said elements and said bar.

6. Apparatus for winding a continuous strip of material such as paper as said strip is intermittently or continuously fed from an adjacent station, comprising:

a mandrel about which said strip is to be wound;

means for rotating said mandrel to wind said strip;

means for supporting said strip at two spaced locations upstream of said mandrel, whereby a free loop profile is assumed thereby;

laterally adjustable paper guide means extending outwardly beneath said mandrel for confining lateral movement of said strip as it is wound on said mandrel, said guide means comprising cradle means for supporting said mandrel when said mandrel is disengaged from said rotating means; and means positioned to coact with said strip between said two spaced locations for actuating said means for rotating in response to the magnitude of the portion of said strip between said two spaced locations.

7. Apparatus according to claim 6, wherein said laterally adjustable guide means comprises at least one elongated bar over which said strip passes as it approaches said mandrel; means for positioning said strip along the length of said bar; and means for bending said strip at least partially around said bar.

8. Apparatus according to claim 7, wherein said positioning means comprise a pair of laterally adjustable collars on said bar, said collars being positioned to coact with the edge of said strip.

9. Apparatus according to claim 7, wherein said bending means comprises a pair of friction elements spaced adjacent to said bar, said strip being threaded between said elements and said bar.

* * * * *